US005809659A

United States Patent [19]

Martin

[11] Patent Number: 5,809,659

[45] Date of Patent: Sep. 22, 1998

[54] ANGLE GUIDE INSTRUMENT

[76] Inventor: Lawrence R. Martin, 18316 Woodside Dr., Hagerstown, Md. 21740

[21] Appl. No.: 743,097

[22] Filed: Nov. 4, 1996

[51] Int. Cl.[6] ..... B43L 7/12

[52] U.S. Cl. ..... 33/451; 33/418; 33/421; 33/424; 33/465

[58] Field of Search ..... 33/451, 343, 370, 33/371, 372, 373, 418, 419, 420, 421, 424, 425, 430, 452, 464, 465, 471, 473, 529, 530, 534, 538, 562

[56] References Cited

U.S. PATENT DOCUMENTS

| | | | |
|---|---|---|---|
| 700,326 | 5/1902 | Hamel . | |
| 776,325 | 11/1904 | Hodge . | |
| 868,700 | 10/1907 | Roberts . | |
| 1,000,133 | 8/1911 | Urbach . | |
| 1,142,527 | 8/1915 | Olson . | |
| 1,925,708 | 9/1933 | Wheeler | 33/418 |
| 3,015,164 | 1/1962 | Antell | 33/473 |
| 4,712,307 | 12/1987 | Kish . | |
| 4,745,689 | 5/1988 | Hiltz . | |
| 4,922,621 | 5/1990 | Maier . | |
| 4,955,141 | 9/1990 | Welch | 33/451 |
| 5,446,969 | 9/1995 | Terenzoni . | |
| 5,533,270 | 7/1996 | Van Der Heiden | 33/424 |

*Primary Examiner*—Christopher W. Fulton
*Attorney, Agent, or Firm*—Dowell & Dowell, P.C.

[57] ABSTRACT

An angle guide instrument having particular utility for handrail installation which includes a body portion having an outer arcuate edge and first and second arms which are pivotable with respect to the body and are used in conjunction with levels mounted to the body for determining angles for purposes of cutting sections of handrail. In a preferred embodiment the arms include extensions which are profiled so as to be cooperatively seated with a section of handrail.

19 Claims, 3 Drawing Sheets

FIG. 1
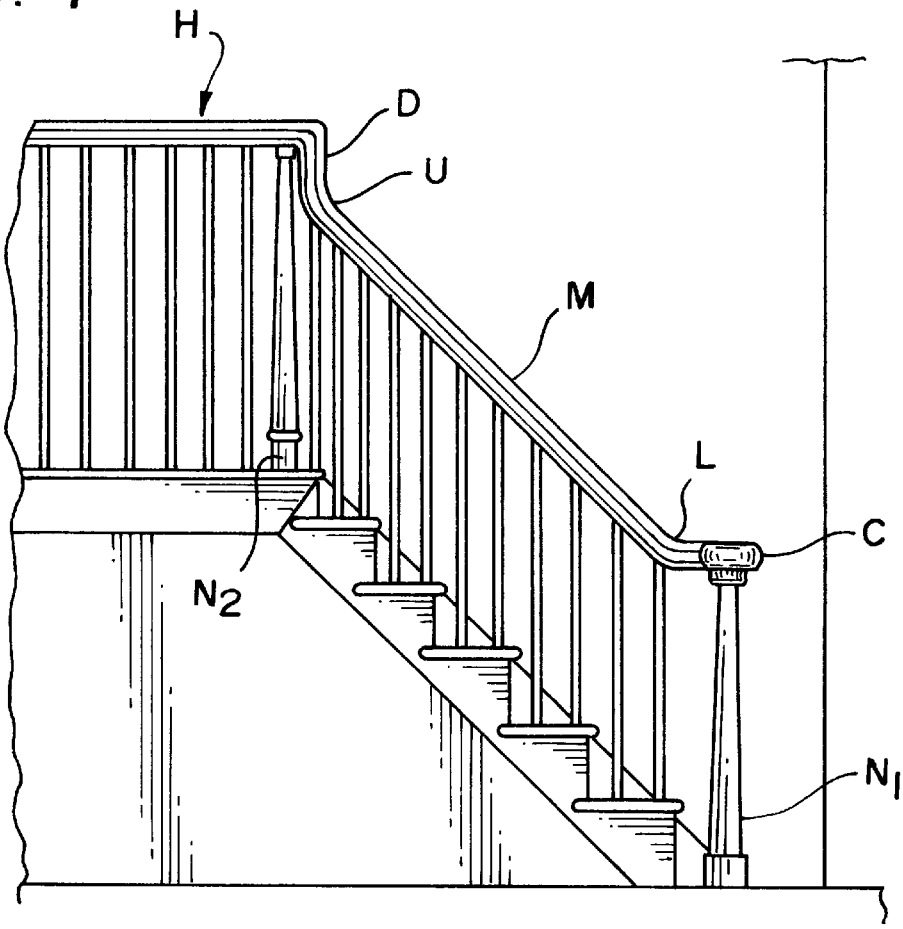
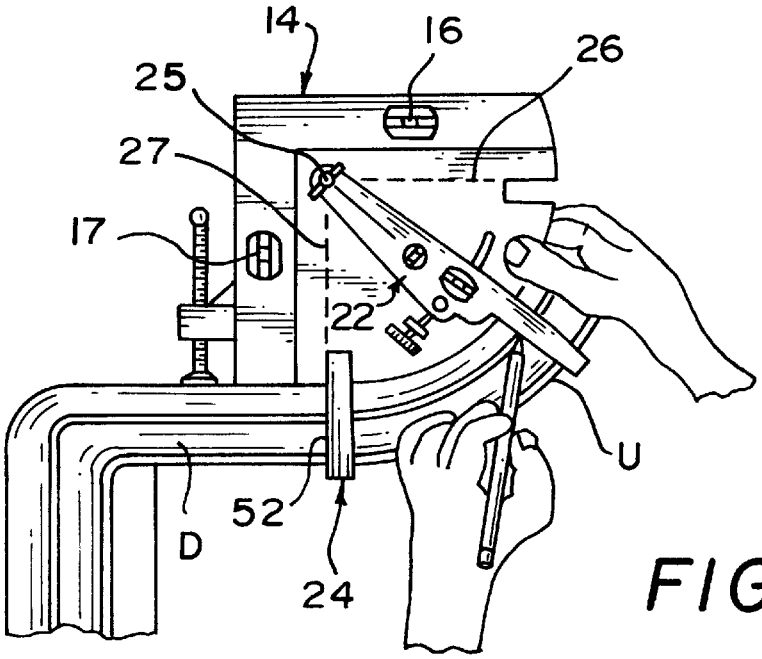
FIG. 6

FIG. 4
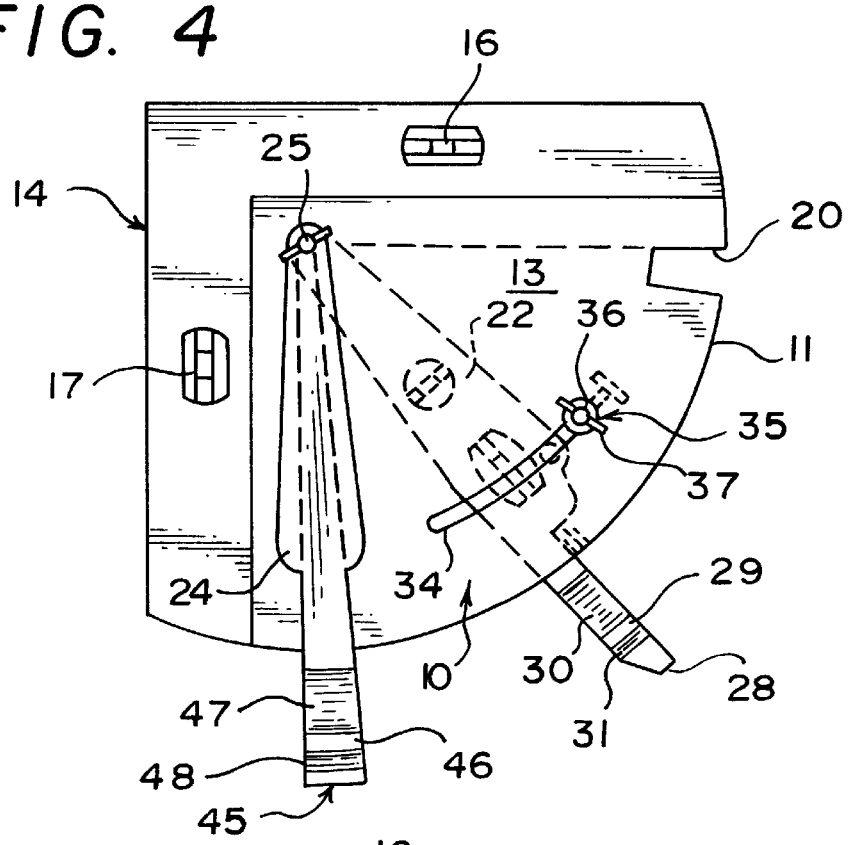
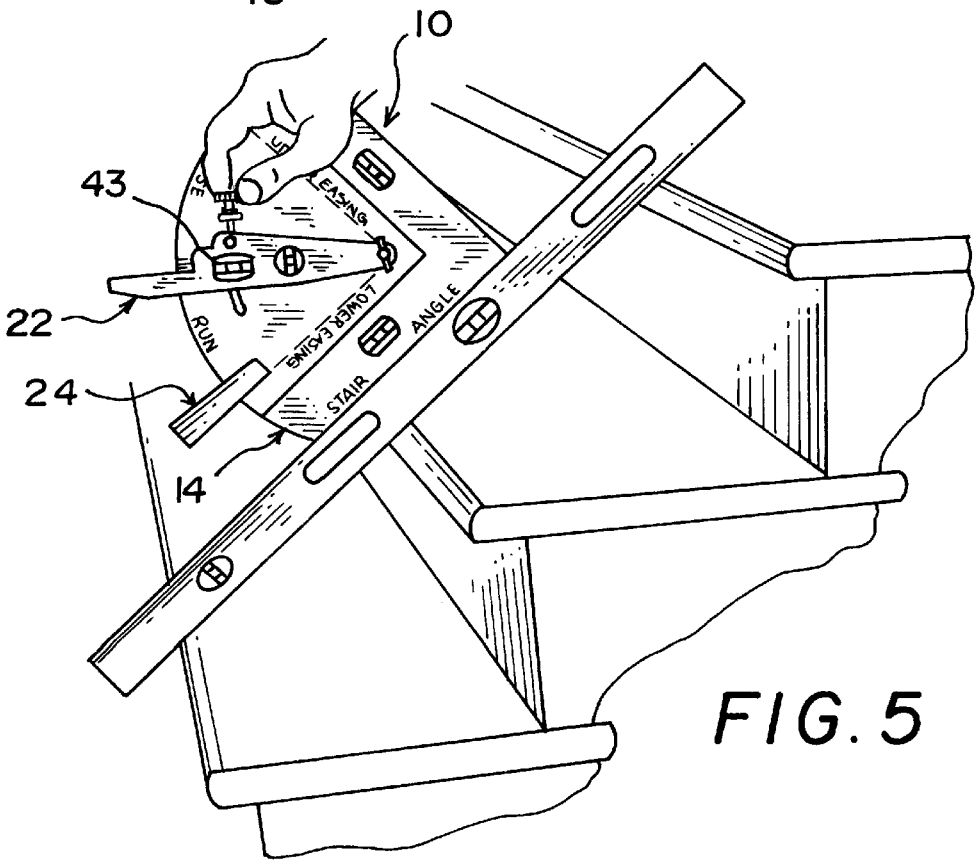
FIG. 5

ANGLE GUIDE INSTRUMENT

BACKGROUND OF THE INVENTION

1. Field of the Invention

This invention is generally related to geometrical instruments for determining angles and, more particularly, to an angle guide instrument for determining and thereafter replicating angles in stairway handrail construction and the like.

2. History of the Related Art

Carpenters, and in particular, those performing staircase handrail installation, are confronted with the need to accurately mark angle lines on handrail members which must be precisely cut. In this regard, the precise angle necessary is not readily determinable but is directly based upon the angle of the steps defining the staircase. This task may be done in various ways requiring techniques which are time consuming using a number of complex manipulations which are often inaccurate. To date, no prior art implements have been designed to facilitate the task of accurately ensuring the alignment and proper positioning of handrails for specific staircases. In addition, prior art instruments have not been designed to provide for replication of angles once they have been properly determined so as to reduce time and labor while ensuring that handrails are properly constructed to meet building codes and regulations.

In the installation of staircases and handrails, local codes dictate the required staircase dimensions as well as angles. Further, the height of a handrail is specified by code and inspections are required to ensure that handrails fall directly within the limits of the code. The angle at which a staircase is installed varies especially due to construction parameters including ceiling height, staircase configuration, landings and related structural features. Most building codes require that staircases be installed within an angle of approximately 37½° to 42½° degrees. Therefore, a carpenter on the scene must be able to ensure that the handrail is properly installed so as to parallel the stairs along the length of each staircase.

Implements such as levels are frequently utilized to determine horizontal and vertical positioning. These tools have also been utilized in an attempt to approximate the cutting angles for matching components of a staircase handrail. Often such components will include a lower easing which extends from a convolute or other end portion which is mounted to a post or newel. This lower easing must be appropriately marked and cut so as to form a naturally appearing extension of a linear run of the main handrail which extends parallel to the toe or tip of the steps intermediate the lower post or newel to a landing newel or an upper floor newel. Often, a newel on a landing or an upper floor will require an upper easing member which includes a rail drop to which is affixed an upper easing member or segment which also must be marked and properly cut in order to form a naturally appearing extension of the handrail extending between the base post or newel and the intermediate landing or upper floor newel.

In view of the foregoing, there remains a need for a simple, durable, inexpensive, multiple-purpose instrument which is capable of accurately and easily determining and thereafter replicating the desired angles for precisely cutting and assembling stairway handrail members. Such a device must be compact, portable and easy to use without the need for additional or supplemental instruments.

SUMMARY OF THE INVENTION

The angle guide implement of the present invention is somewhat triangular in configuration and includes a main body which is generally planar having front and rear surfaces. A portion of the outer periphery of the main body is formed as an arcuate edge of predetermined dimension. In the preferred embodiment, the body includes a right angle frame from which an arcuate portion extends and which frame may be of greater thickness dimension than the arcuate portion. Separate levels may be placed within each of the arms of the right angle frame for purposes of leveling when determining marking angles utilizing the implement. In addition, indicia in the form of rulings or scales may be provided along each of the arms of the frame for purposes of measuring dimensions.

The body is generally formed as a arc or wedge segment of a circle with the arcuate edge running at least 90°. In the preferred embodiment, notches are formed extending inwardly from the outer arcuate edge of the body and at 90° relative to one another. Two arms are pivotably mounted at their inner ends on opposite sides of the body to a vertex defined by the 90° angle of the arcuate edge. Each of the arms includes an outer extension including profiled surfaces which are designed to match the exterior profile of a conventional handrail. In the preferred embodiment, such profiling matches a 60/10 handrail configuration although other handrail configurations may be used. The outer extensions extend beyond the arcuate edge of the body and their profiling allows the arms to be aligned with and seated against the exterior surface of a contoured section of handrail with the arcuate edge of the body engaging an arcuate concave upper surface of a handrail easing. In this respect, the predetermined dimension of the arcuate edge is designed to be complimentary to the arcuate features of a specific type of handrail easing. By way of example, a 60/10 handrail easing member has an arc based on a radius of approximately 7 inches. Therefore, the arcuate edge of the body would be defined having the same radius.

The first of the arms is utilized to determine the rake angle or the angle at which an easing segment of the handrail is to be cut in order to properly align the easing with the main portion of the handrail. This first arm is pivotably movable with respect to a gauge or marked set of indicia which are provided on the surface of a portion of the body adjacent the arcuate edge. The gauge is normally read in degrees from approximately 37° to 43° at one quarter to one half of a degree increments. In the preferred embodiment, two bubble levels, one for horizontal alignment and one for vertical alignment are mounted within spaced openings in the first or rake arm. A first of the levels is oriented generally perpendicularly with respect to the elongated axis of the arm and a second is oriented parallel to an elongated axis extending from the pivot point for the arm at the vertex of the arcuate edge. This second level is utilized for purposes of determining the exact angle of the steps of the staircase which angle will normally be between 37½° to 42½° as required by most building codes. To control the movement of the first arm and to retain the first arm in a predetermined position, an adjustment knob is mounted to an appropriate receiver secured to the arm and which is slideably received in a arcuate slot formed in the body. The knob may be rotated to make minor adjustments in the positioning of the arm relative to the body.

The second or easing arm is mounted on the opposite side of the body and is positioned along one of the right angle lines extending from the arcuate edge to the vertex depending upon whether a lower easing handrail segment or upper easing handrail segment is being marked. The second arm is designed to be seated within one of the slots or notches formed in the body. In this respect, any other appropriate means for securing the easing arm relative to the body including frictional devices or stops may be utilized.

As previously noted, the levels in the right angle frame facilitate the marking of points for cutting upper and lower easing handrail members. Utilizing the implement, the cutting angles for both the upper and lower easing segments are exactly determined so as to insure the easings align with the main portion of the handrail extending parallel to the steps. Thereafter, such angles may be replicated for cutting the easing segments of an adjacent handrail.

It is the primary object of the present invention to provide an improved angle guide implement which overcomes the disadvantages of the prior art and allows angles to be quickly and accurately marked for cutting handrail easing segments so that they align properly with the main portion of a handrail.

It is another object of the present invention to provide an improved angle guide implement which may be operated quickly with little or no risk of inaccuracy and which thereby reduces the time required for handrail installations and which also reduces waste and cost overruns often associated with handrail construction.

It is yet another object of the present invention to provide an improved angle guide implement which may be used without auxiliary tools or complicated mathematical calculations for purposes of installing handrails to ensure that they are exactly within building code requirements.

BRIEF DESCRIPTION OF THE DRAWINGS

The various features and advantages of the present invention will be more fully understood with reference to the drawings wherein:

FIG. 1 is an illustrational view of a portion of a staircase showing the upper and lower handrail easing segments which have been cut utilizing the angle guide implement of the present invention to assure that the segments are exactly aligned with the main portion of the handrail which extends generally parallel to the leading edge of the stair treads of the staircase.

FIG. 4 is a bottom plan view of the implement of the present invention.

FIG. 5 an illustrational view showing the angle guide implement being utilized to determine the angle of the stairs in order to set the lower easing angle associated with the handrail shown in FIG. 1.

FIG. 6 is an illustrational view of the angle guide implement of the present invention shown when marking the upper easing cutting angle associated with the handrail illustrated in FIG. 1.

DESCRIPTION OF THE PREFERRED EMBODIMENT

Figure 2:
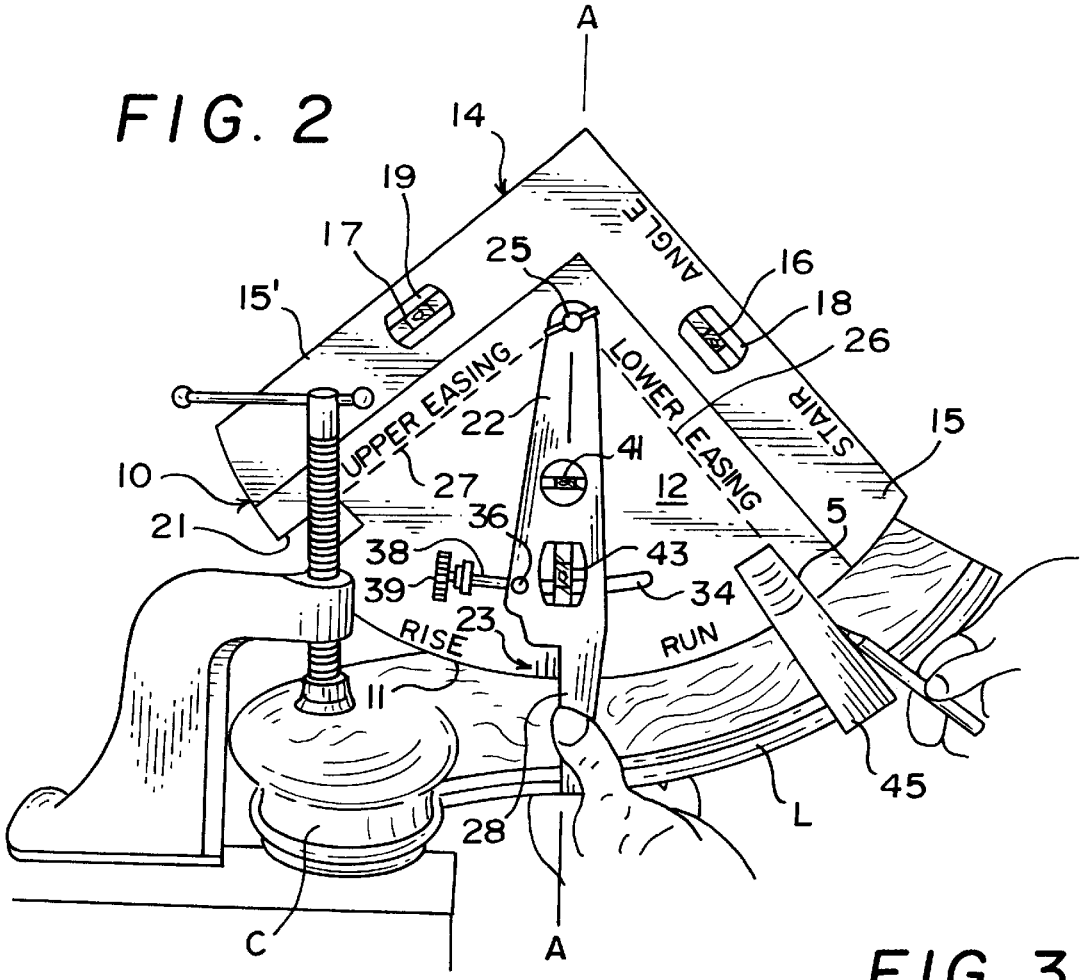
FIG. 2 is an illustrational view showing the upper surface of the angle guide implement of the present invention utilized to mark the angle of a lower easing segment of the handrail shown in FIG. 1.

With continued reference to the drawing figures, the preferred embodiment of angle guide implement of the present invention will be described in greater detail and particularly with respect to its use in the construction and installation of handrails "H". The handrail includes a main portion "M" which extends generally parallel to the outer edge of the tread portion of the steps. The main portion of the handrail is connected at its lower and upper ends with a lower easing segment and an upper easing segment, "L" and "U", respectively. The segments are manufactured having predetermined configurations and generally include, at the base of the staircase, a convolute "C" having an arcuate portion extending therefrom and upwardly with respect thereto. The convolute is mounted to a lower post or newel $N_1$. The easing segment or member must be cut at a specific angle and at a specific point so as to properly align with the main portion of the handrail so as to function as an extension thereof, as shown in FIG. 1. In a like manner, and as shown in FIG. 1, the upper easing segment extends in arcuate fashion from a rail drop "D" associated with an upper newel $N_2$ either at a landing or on a second floor of the staircase. The upper easing segment must also be properly cut to ensure that it is a natural extension of the handrail.

The implement comprises a body portion 10 having an outer arcuate edge 11 wherein the body is formed as a arc segment of generally triangular shape. The curvature of the arcuate edge is predetermined, as previously discussed, so that it conforms with the curvature of the upper surface of a handrail easing and, in the embodiment shown, is for use in measuring angles associated with 60/10 handrail profiles. It should be noted that different handrail profiles may be marked utilizing implements designed in accordance with the teachings of the present invention such as 70/12, 70/40, 70/45 or other specialized handrails. In the preferred embodiment, the body is shown as having upper and lower surfaces 12 and 13 which are generally planar in configuration. The body includes a right angle frame 14 having arm portions 15 and 15' defining outer straight edges. The outer straight edges may be utilized for purposes of measuring distance and may include indicia or other scales (not shown). Levels 16 and 17 are mounted within openings 18 and 19 in the arms of the frame.

Along the arcuate edge 11 of the body are spaced markings or indica 23 which indicate an angle in degrees ranging from approximately 37° to 43° which is slightly greater than the generally accepted range for stairway inclination in most jurisdictions. The body is further provided with a pair of notches 20 and 21 which are oriented so that there outermost edges are aligned at 90° relative to one another. The notches serve as stops for retaining one of two arms 22 and 24 which are pivotably mounted at pivot point 25 to the upper and lower surfaces of the body, respectively. The pivot point 25 is located at the vertex of two lines referenced the lower easing line 26 and the upper easing line 27 which define the 0° and 90° angles of the arcuate edge 11.

Figure 3:
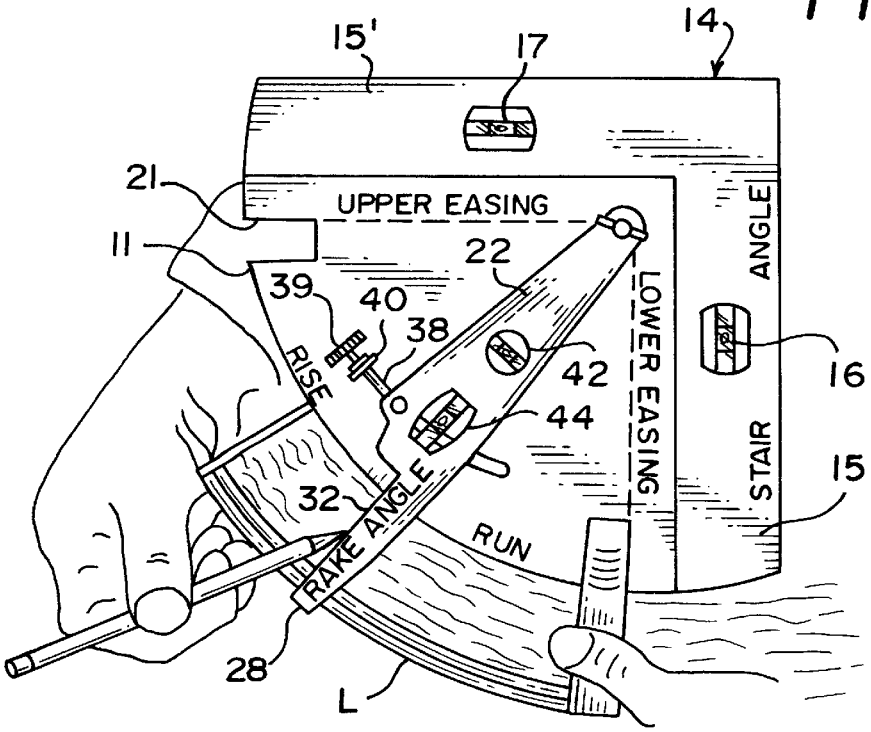
FIG. 3 is an illustrational view showing the angle guide implement of the present invention utilized to mark the angle for cutting the lower easing segment of a handrail associated with the opposite handrail of a staircase (not shown in FIG. 1).

The first or rake arm 22 is utilized to determine a rake angle for cutting the lower and upper easing segments and includes an outer portion or extension 28 which extends beyond the arcuate edge 11 of the body and which includes a profiled inner surface 29 including two concave areas 30 and 31, as shown in FIG. 4. The profiled inner surface is complementary to the profiling of the particular type of handrail easing being measured. This allows the outer extension 28 to be cooperatively seated against the surface of a handrail section, as is shown in FIGS. 2, 3 and 6 when in use. The outer extension 28 includes a marking edge 32 utilized as a guide for scribing a line for purposes of cutting a segment of handrail easing as will be described in greater detail hereinafter.

In order to secure the rake arm in an appropriate position, an arcuate slot 34 is provided through the body through which a locking member 35 is disposed. The locking member includes a pivot cam 36 which extends through the slot and into an opening in the rake arm. The opposite end of the locking member includes a wing nut or other locking device 37 which is used to anchor or lock the rake arm relative to the angle markings formed adjacent the arcuate edge 11 of the body. The cam has a central threaded opening (not shown) through which a threaded shaft 38 associated with an adjustment screw 39 is threadingly received. The adjustment screw is threadingly mounted through an opening in an anchoring clevis 40 mounted to the upper surface of the body. By preliminarily placing the arm in a first position relative to the angle gauge or markings, minor adjustments may thereafter be made by rotating the adjustment screw to thereby precisely set an angle.

The rake arm further includes a horizontal bubble level 41 which extends generally perpendicularly to an elongated axis A—A of the arm and which is mounted in an opening 42. The axis A—A is aligned with markings edge 32, as shown in FIG. 2. A second vertical bubble level 43 is mounted within an opening 44 in the rake arm and extends parallel to the elongated axis A—A and the marking edge of the rake arm. This second level is utilized for determining the angle of a staircase as will be described in greater detail hereinafter.

The second or easing arm 24 is utilized with the rake arm to mark lines for the lower and upper easing segments and is also pivotable about the pivot point 25. The easing arm 24 is selectively aligned and locked within the notches 20 and 21 formed in the body. In this respect, the easing arm may be lifted or urged from one of the notches and pivoted along the rear surface of the body and thereafter allowed to snap into the other of the notches depending upon whether the easing angle being measured is for a lower or upper easing segment. The easing arm further includes an outer extension or portion 45 which extends outwardly with respect to the arcuate edge 11 of the body and which has a profiled inner surface 46 which is configured to match the shape of the inner profile of the rake extension and which is complimentary therefor to the profile of an outer portion of a handrail, such as a 60/10 handrail. The inner surface, as shown in FIG. 4, includes concave recesses 47 and 48. In this way, the easing arm may also be seated in abutting relationship with respect to an outer surface portion of a handrail which is being measured, as shown in FIGS. 2, 3 and 6.

The angle guide implement of the present invention is preferably made of sturdy, rigid material such as aluminum or plastic. However, wood materials may also be used.

As an initial step, the angle of the staircase is determined by placing the angle guide implement on a straight edge, as shown in FIG. 5, so that it rests on at least two stairs. Thereafter, the rake arm 22 is moved until the bubble level 43 is centered. This will determine the exact angle of the staircase and will also indicate the precise angle for cutting the lower and upper easing handrail segments. Once this angle has been determined, the angle guide implement is placed in an upright vertical position, as shown in FIG. 2, on a stationary and leveled lower easing segment "L" so that the arcuate edge 11 of the instrument rests in the arc of the lower easing handrail segment. As previously disclosed, the arcuate edge of the implement is compatible to the arc of the handrail. Thereafter, the easing arm 24 is moved to the lower easing angle marking position 26 by inserting the outer portion thereof within the notch 20. The implement is placed so that the outer extensions 28 and 45 of the rake arm 22 and the easing arm 24 are seated against the outer profile of the lower easing. In FIG. 2, the inner surface of the handrail lower easing shown in FIG. 1 is being marked. The marking edge 32 of the rake arm is horizontally positioned relative to the easing segment utilizing the bubble level 41 to align with the point at which the easing begins to curve upwardly. Thereafter, a marking edge 50 of the extension of the easing arm 24 is used as a guide to strike a line indicating the proper angle for cutting the lower easing segment. The angle will be between 37½° and 42½°.

In FIG. 3, an outer surface of the lower easing of a handrail opposite to that shown in FIG. 1 is being marked wherein the marking edge 50 of the easing arm 24 is aligned vertically at the proper point by utilizing the bubble level 17 associated with the right angle frame. Thereafter, the proper rake angle is marked utilizing the marking edge 32 of the extension of the rake arm, as shown.

To mark the appropriate angle for cutting the upper easing "U" of the handrail, the rake arm 24 is retained in its adjusted position. The angle at which the upper easing must be cut is a reverse angle determined by subtracting the angle determined for the staircase, that is, the angle for cutting the lower easing, subtracted from 90°. The sum of the cut for the lower easing angle and the upper easing angle will therefor total 90°. As shown in FIG. 6, the easing arm 24 is lifted from the notch 20 and pivoted about the pivot point 25 and seated within the notch 21. To effect the proper mark, the arcuate edge 11 of the body of the implement is aligned at the point between the end of the stair drop "D" and the beginning of the upper easing segment of the handrail. Utilizing the bubble level 16, the outer edge 52 of the extension of the easing arm is vertically aligned along line 27 with the pivot point 25. Thereafter, a strike line is marked utilizing the edge 32 of the rake arm 22. Again, during the marking procedure, the inner surface portions of the extensions of the easing arm and the rake arm are cooperatively seated against the profiling of the upper easing segment of the handrail.

Once the upper and lower easing angles have been marked and appropriately cut, the upper and lower easings are assembled to the middle portion of the handrail with the resulting handrail construction being shown in FIG. 1. In order to mark the opposite upper easing segment of the opposite handrail (not shown) the implement is utilized in a manner using the procedure set forth previously with respect to marking of the lower easing angle wherein the rake arm is aligned vertically between the rail drop and the upper easing segment while an edge of the easing arm is used to form the strike line indicating the angle at which the upper easing should be cut.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

I claim:

1. An angle marking implement adapted for use in marking angles for cutting upper and lower handrail easing segments comprising, a body having an outer arcuate edge and front and rear surfaces, a first rake arm pivotably mounted about a pivot point spaced from said arcuate edge, said pivot point being positioned at a radius defined by said arcuate edge whereby said rake arm is pivotable so as to be radially aligned at different angles relative to said arcuate edge, a second easing arm pivotably mounted to said body about said pivot point and being pivotably movable relative to said outer arcuate edge from a first 0° position to a second position oriented 90° with respect to said first position, said first rake arm having a marking portion in alignment with said pivot point, a first level means mounted to said first rake arm and extending parallel to a line extending from said pivot point to said marking portion of said rake arm, and at least one secondary level means for use in aligning said second easing arm relative to an upper or lower easing segment.

2. The angle marking implement of claim 1 including angle markings disposed on said upper surface of said body, said angle markings including indicia for marking angles including approximately 37° to 43° relative to said pivot point and said first position of said second easing arm.

3. The angle marking implement of claim 1 including adjusting means for securing said first rake arm relative to said body.

4. The angle marking implement of claim 3 wherein each of said first rake arm and said second easing arm include outer extension portions which extend outwardly beyond said outer arcuate edge of said body.

5. The angle marking implement of claim 4 in which each of said outer extension portions includes contoured surfaces adapted to allow said extension portions to be cooperatively seated against an easing segment.

6. The angle marking implement of claim 5 in which said first rake arm is pivotably mounted to said upper surface and said second easing arm is pivotably mounted to said lower surface of said body.

7. The angle marking implement of claim 6 including a second level means mounted to said first rake arm, said second level means being oriented perpendicularly with respect to said first level means.

8. The angle marking implement of claim 7 including a pair of spaced notches formed extending inwardly of said body from said outer arcuate edge, said notches being located in alignment with said first and second positions, said second easing arm being selectively seated within said notches when in said first and said second positions.

9. The angle marking implement of claim 8 in which said body includes a right angle frame having arm portions extending at 90° relative to one another, said at least one secondary level means being mounted to one of said arm portions of said right angle frame and parallel with said first position and a second level mounted to the other arm portion extending generally parallel with said second position.

10. The angle marking implement of claim 9 including angle markings disposed on said upper surface of said body, said angle markings including indicia for marking angles including approximately 37° to 43° relative to said pivot point and said first position of said second easing arm.

11. The angle marking implement of claim 9 in which said one of said arm portions of said frame includes an outer edge which extends parallel to said first position of said second easing arm.

12. The angle marking implement of claim 1 in which said body includes a right angle frame having arm portions extending at 90° relative to one another, said at least one secondary level means being mounted to one of said arm portions of said right angle frame and parallel with said first position and a second level mounted to the other arm portion extending generally parallel with said second position.

13. The angle marking implement of claim 1 wherein each of said first rake arm and said second easing arm include outer extension portions which extend outwardly beyond said outer arcuate edge of said body and each of said outer extension portions includes contoured surfaces adapted to allow said extension portions to be cooperatively seated against an easing segment.

14. The angle marking implement of claim 1 in which said first rake arm is pivotably mounted to said upper surface and said second easing arm is pivotably mounted to said lower surface of said body.

15. The angle marking implement of claim 1 including a second level means mounted to said first rake arm, said second level means being oriented perpendicularly with respect to said first level means.

16. The angle marking implement of claim 1 including a pair of spaced notches formed extending inwardly of said body from said outer arcuate edge, said notches being located in alignment with said first and second positions, said second easing arm being selectively seated within said notches when in said first and said second positions.

17. An angle guide apparatus for determining and replicating angles comprising, a main body member having a generally triangular shape having two sides forming a right angle portion which are joined by an arcuate edge extending at least 90° therebetween, said arcuate edge including indicia for determining degree of an angle, a level means mounted to each of said sides of said right angle portion, a first arm pivotably connected to a first side of said main member at a vertex with respect to said arcuate edge, a vertical level and a horizontal level mounted to said first arm, means for adjusting the position of said first arm relative to said arcuate edge about said vertex, said first arm having a portion extending beyond said arcuate edge, a second arm pivotably mounted at said vertex and on a second side of said main body member, said second arm having an outer portion which extends beyond said arcuate edge and means for aligning said second arm so as to aligned at first and second positions along said arcuate edge which are spaced at a 90° angle with respect to said vertex.

18. The angle guide apparatus of claim 17 wherein said means for aligning said second arm includes a pair of slots formed extending inwardly of said main body from said arcuate edge.

19. The angle guide apparatus of claim 18 wherein each of said outer portions of said first and second arm are concavely profiled in the same configuration.

* * * * *